US007094109B2

(12) United States Patent
Chou

(10) Patent No.: US 7,094,109 B2
(45) Date of Patent: Aug. 22, 2006

(54) POWER SUPPLY COUPLING TERMINAL

(75) Inventor: Ching-Lin Chou, Taipei Hsien (TW)

(73) Assignee: Topower Computer Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 11/078,423

(22) Filed: Mar. 14, 2005

(65) Prior Publication Data

US 2005/0208837 A1 Sep. 22, 2005

(30) Foreign Application Priority Data

Mar. 17, 2004 (TW) ..... 93204032 U

(51) Int. Cl.
*H01R 25/00* (2006.01)

(52) U.S. Cl. ..... 439/651

(58) Field of Classification Search ..... 439/650–652, 439/654, 655

See application file for complete search history.

(56) References Cited

U.S. PATENT DOCUMENTS 4,909,746 A * 3/1990 Scholz ..... 439/82
5,064,389 A * 11/1991 Klein et al. ..... 439/651
5,137,462 A * 8/1992 Casey et al. ..... 439/74
5,855,064 A * 1/1999 Chang ..... 29/861

* cited by examiner

*Primary Examiner*—Ross Gushi
(74) *Attorney, Agent, or Firm*—Birch, Stewart, Kolasch & Birch, LLP

(57) ABSTRACT

An improved power supply terminal to prevent defects and output voltage drop of the power supply and reduce the total cost, and to bridge a power supply connector and insertion slots of a mainboard includes twenty-four first coupling slots on an upper end and twenty or twenty-four second coupling slots on a lower end. The coupling slots are opposing each other and not connected by conductive wires. Thereby it can be coupled with different types of power supply connectors and mainboard insertion slots. Defects and output voltage drop of the power supply can be prevented. Due to no conductive wires and separated design of the coupling slots and the coupling pins is not necessary, molding, material, and fabrication and assembly costs are reduced.

2 Claims, 5 Drawing Sheets

POWER SUPPLY COUPLING TERMINAL

FIELD OF THE INVENTION

The present invention relates to an improved power supply coupling terminal for bridging a power supply connector and insertion slots of a mainboard that has first coupling slots on an upper end and second coupling slots on a lower end that oppose each other and are not connected by any conductive wires to be coupled with different types of power supply connectors and mainboard insertion slots to prevent defects and output voltage drop of the power supply and also reduce molding, material, and fabrication and assembly costs.

BACKGROUND OF THE INVENTION

Power supply is an indispensable device for normal operation of a computer. The power supply has an output connector to couple with a power supply socket of the mainboard. The power supply connectors now on the market generally have two types: one has twenty slots, the other has twenty-four slots. The mainboard socket also has two types: one has twenty slots and the other has twenty-four slots to mate the connectors. In the event that the power supply connector has twenty slots and the mainboard socket has twenty slots, or the power supply connector has twenty-four slots and the mainboard socket has twenty-four slots, the power supply connector can be directly inserted in the mainboard slots. But if the power supply connector has twenty slots while the mainboard socket has twenty-four slots, or the power supply connector has twenty-four slots while the mainboard socket has twenty slots, the power supply connector cannot be inserted in the mainboard slots. In such a situation, a coupling terminal has to be used. Refer to FIG. 1 for a conventional power supply to be coupled with a coupling terminal. The conventional coupling terminal A mainly includes first coupling slots A1, conductive wires A2 and second coupling slots A3. The first coupling slots A1 have twenty or twenty-four slots. The second coupling slots A3 have twenty-four or twenty slots. The first coupling slots A1 and the second coupling slots A3 are connected by the conductive wires A2. When in use, a power supply P has an output connector B inserting in the first coupling slots A1 of the coupling terminal A, and the second coupling slots A3 of the coupling terminal A are coupled with the insertion slots of the mainboard. This is the commonly adopted approach now. As the power supply P and the computer host have to be coupled through the coupling terminal A, and the first coupling slots A1 and the second coupling slots A3 are bridged by the conductive wires A2, the distance between the power supply P and the computer host increases. Hence defects and output voltage drop of the power supply P often occur. Power supply received by the computer host could be not adequate. Moreover, the first coupling slots A1 and the second coupling slots A3 are separated and have to be connected by the conductive wires A2 individually. Molding, material, and fabrication and assembly costs are higher.

SUMMARY OF THE INVENTION

In view of the aforesaid problems remained to be resolved, the primary object of the present invention is to provide an improved power supply coupling terminal to overcome the disadvantages mentioned previously.

The improved power supply coupling terminal according to the invention mainly includes first coupling slots on an upper end and second coupling slots on a lower end that oppose each other and are not connected by conductive wires thereby may be coupled with different types of power supply connectors and mainboard insertion slots to prevent defects and output voltage drop of the power supply and also to reduce molding, material, and fabrication and assembly costs.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
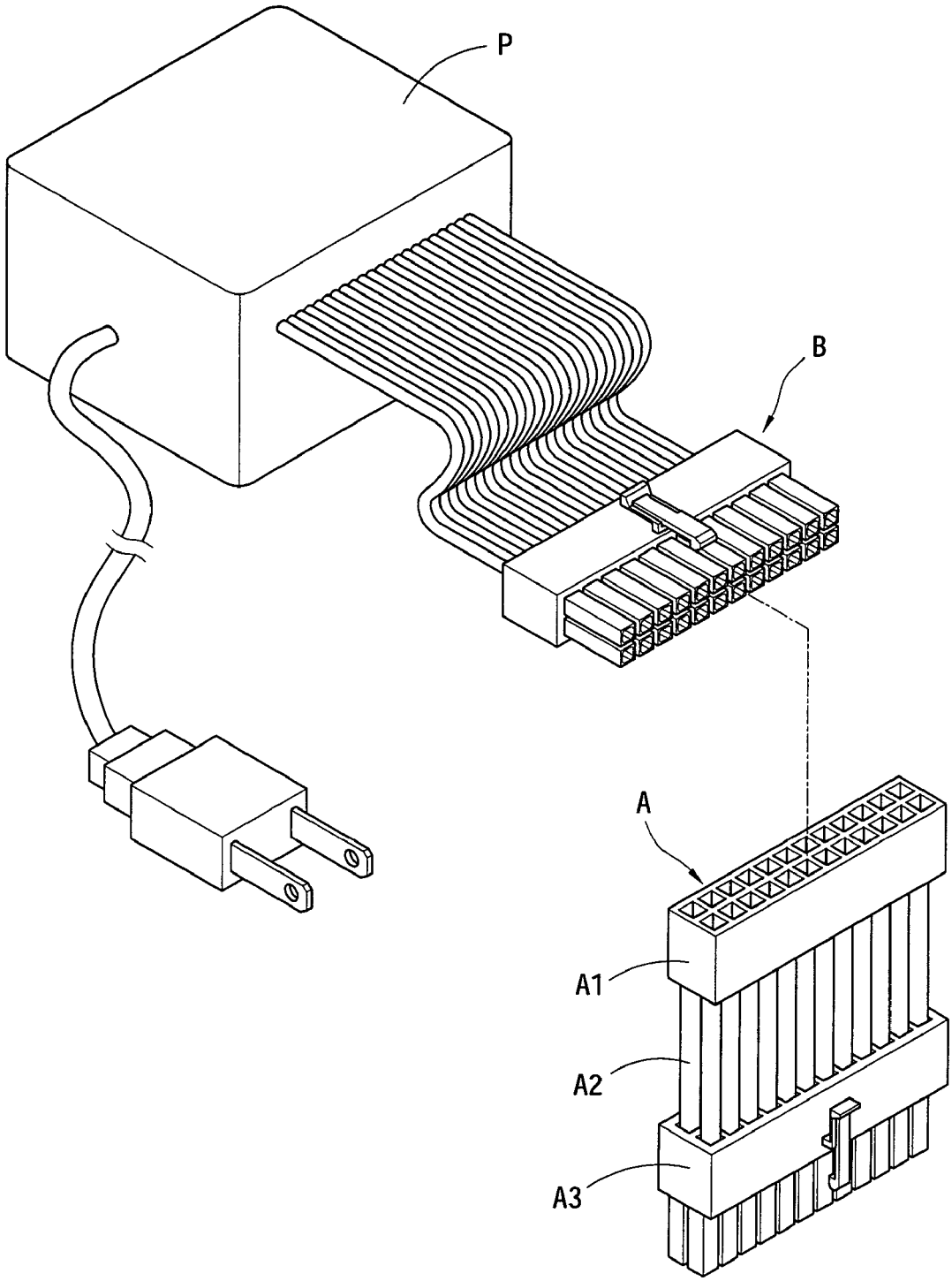
Fig.1 PRIOR ART
FIG. 1 is a schematic view of a conventional power supply and a coupling terminal.
Figure 2:
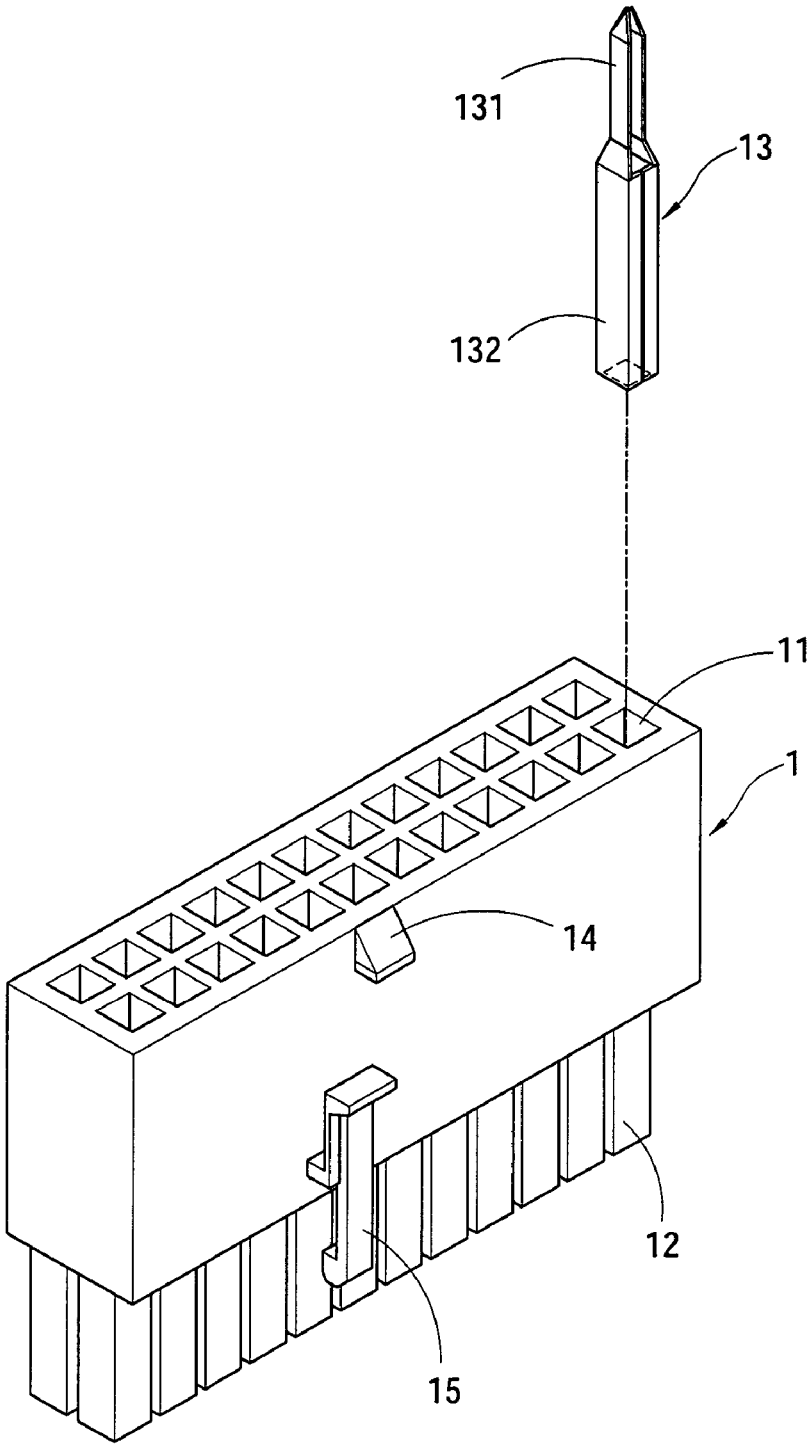
FIG. 2 is a perspective view of the invention.
Figure 3:
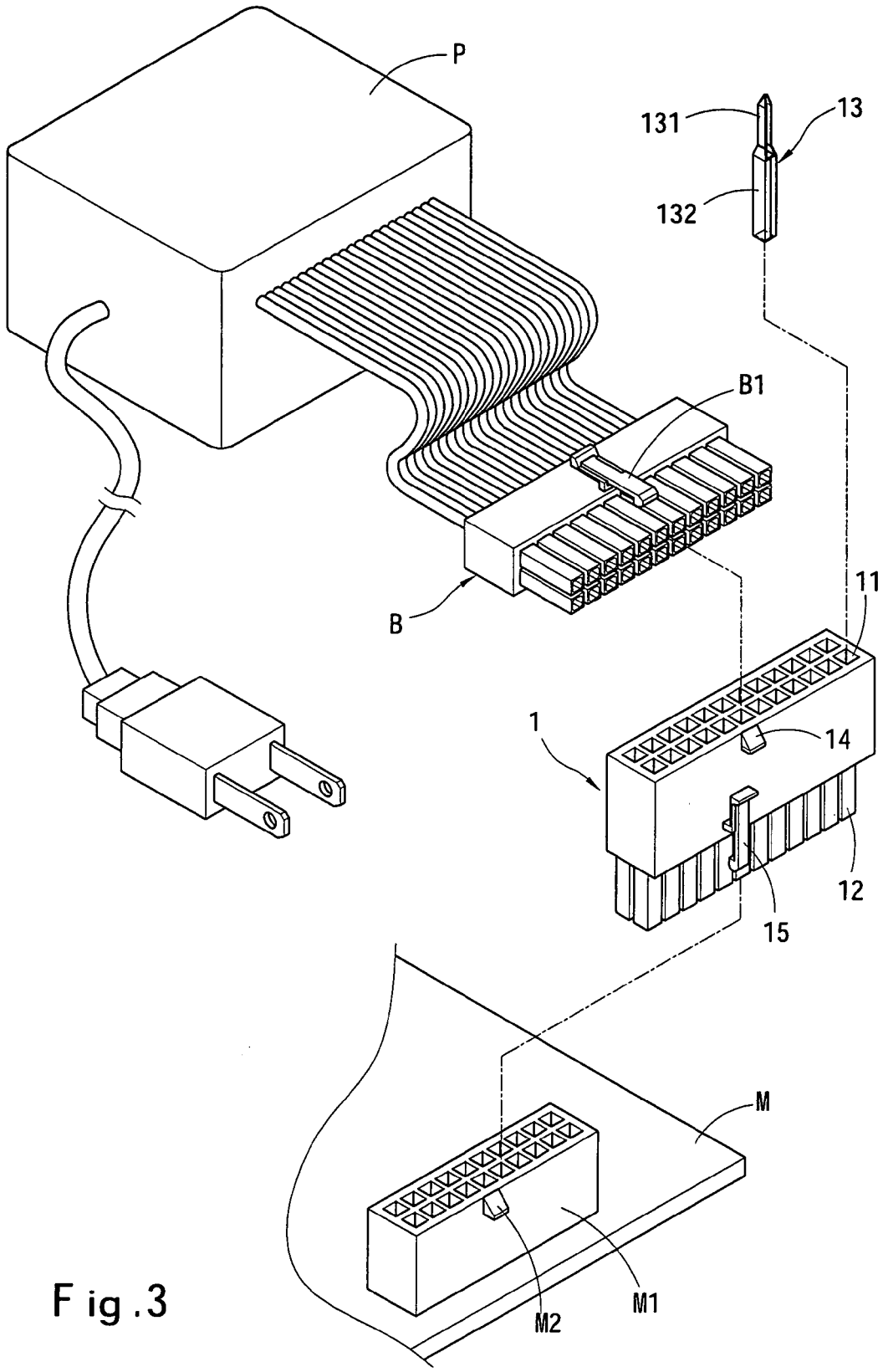
FIG. 3 is an exploded view of the invention to be coupled with a power supply and a mainboard.
Figure 4:
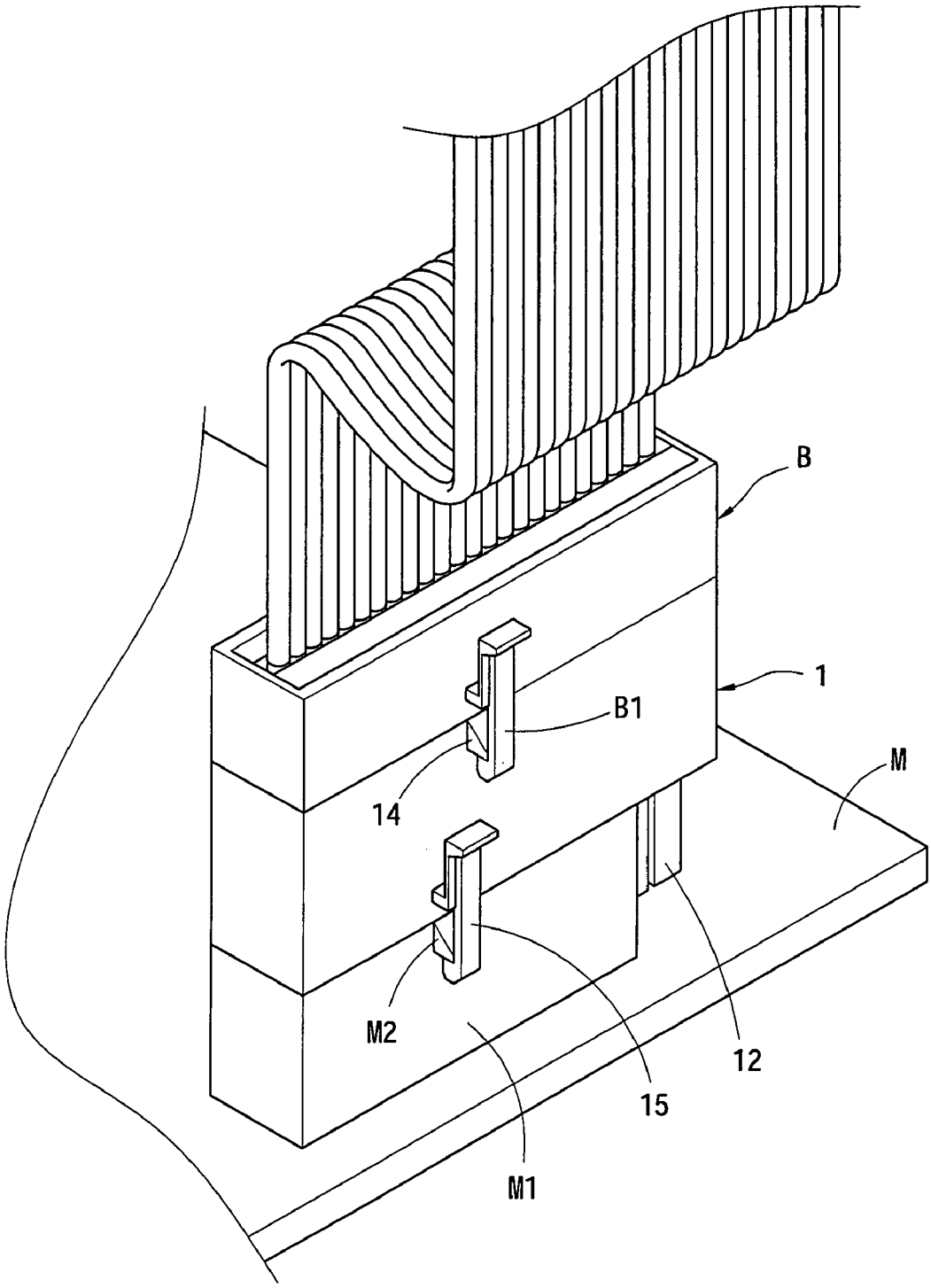
FIG. 4 is a schematic view of the invention coupled with a power supply and a mainboard.

Please referring to FIGS. 2, 3 and 4, the power supply coupling terminal 1 according to the invention mainly includes twenty-four first coupling slots 11 on an upper end, and twenty-four second coupling slots 12 on a lower end that oppose each other and are not connected by conductive wires. Each of the first coupling slots 11 and the second coupling slots 12 is coupled with a coupling pin 13 which has a male connector 131 on one end and a female socket 132 on other end. Hence a connector B of a power supply P can be coupled and connected electrically with the male connector 131 of the coupling pin 13, and the second coupling slots 12 of the coupling terminal 1 may be coupled with insertion slots M1 of a mainboard M. It is to be noted that the main feature previously discussed targets the power supply connector B with twenty-four slots to output electric signals to the insertion slots M1 of the mainboard M that have twenty slots. Namely four slots of the first coupling slots 11 and second coupling slots 12 do not have the coupling pins 13 (or have the male connectors 131 but without the female sockets 132). Moreover, the coupling terminal 1 has a latch hook 14 on one side to be latched by a coupling clip B1 on the power supply connector B, and a latch clip 15 to be latched by a coupling section M2 on the insertion slot M1 of the mainboard M. As the first coupling slots 11 and the second coupling slots 12 are not connected by any conductive wires, defects and output voltage drop of the power supply P resulting from passing through the conductive wires may be prevented. Moreover, as there are no conductive wires, the first coupling slots 11 and the second coupling slots 12 do not have to be designed separately. They may be integrally formed by injection, thus molding, material, and fabrication and assembly costs are reduced.

Figure 5:
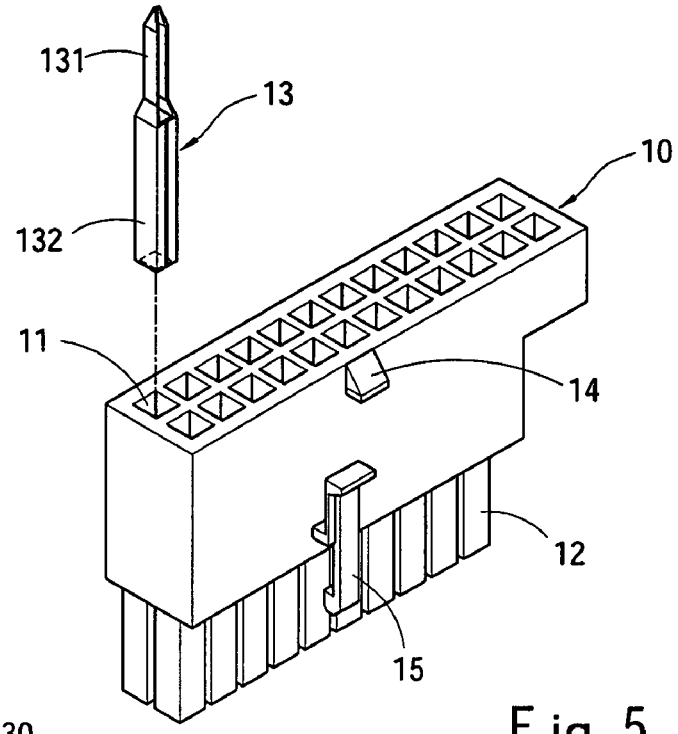
FIG. 5 is a schematic view of a second embodiment of the invention.

Refer to FIG. 5 for a second embodiment of the invention. It differs from the first embodiment previously discussed in that the second coupling slots 12 on the lower end include twenty slots that are integrally formed, while the twenty-four first coupling slots 11 on the upper end remained unchanged. Electricity transforming effect is same as the first embodiment.

Figure 6:
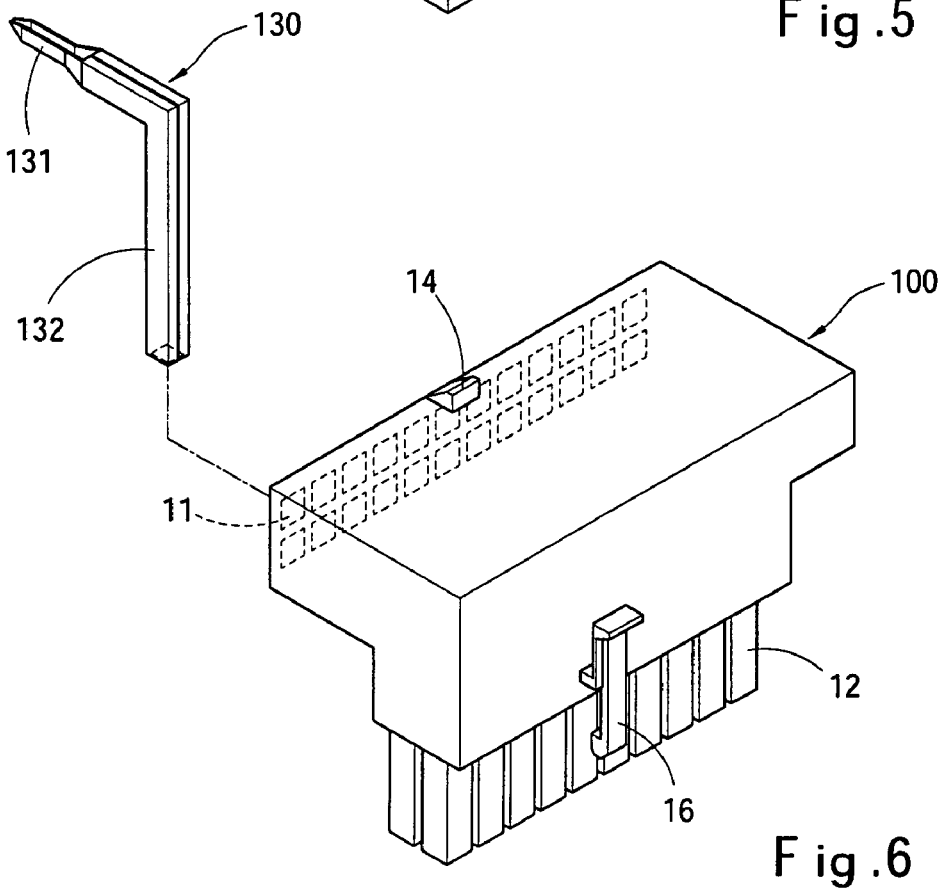
FIG. 6 is a schematic view of a third embodiment of the invention.

Refer to FIG. 6 for a third embodiment of the invention. It differs from the first and second embodiments previously discussed in that the second coupling slots 12 on the lower end include twenty slots that are integrally formed, while the twenty-four first coupling slots 11 on the upper end remained unchanged. However, the first coupling slots 11 and the second coupling slots 12 are vertical to each other. The coupling pin 130 also is bent to form an angle. Electricity transforming effect is same as the previous embodiment. Because of no metal contacts of the conductive wires, defects and voltage drop of electric signal transmission can be prevented.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An improved power supply coupling terminal comprising twenty-four first coupling slots on an upper end and twenty-four second coupling slots on a lower end;

wherein the first coupling slots and the second coupling slots are not connected by conductive wires, twenty of the first coupling slots and twenty of the second coupling slots being respectively coupled with a coupling pin which has a male connector on one end and a female socket on other end such that the first coupling slots are engageable with a power supply connector, and the second coupling slots are insertable in insertion slots of a mainboard, the other four of the first coupling slots and the other four of the second coupling slots being free of the coupling pin and the conductive wires.

2. The improved power supply coupling terminal of claim 1 further having a latch hook and a latch clip on the surface of one side.

* * * * *